US008520031B2

(12) United States Patent
Shih et al.

(10) Patent No.: US 8,520,031 B2
(45) Date of Patent: Aug. 27, 2013

(54) PIXEL DRIVING METHOD FOR DISPLAY DEVICE

(75) Inventors: Po-Sheng Shih, Tao-Yuan Hsien (TW); Hsuan-Lin Pan, Tao-Yuan Hsien (TW)

(73) Assignee: Hannstar Display Corp., Tao-Yuan Hsien (TW)

( * ) Notice: Subject to any disclaimer, the term of this patent is extended or adjusted under 35 U.S.C. 154(b) by 1326 days.

(21) Appl. No.: 12/035,024

(22) Filed: Feb. 21, 2008

(65) Prior Publication Data

US 2009/0115761 A1 May 7, 2009

(30) Foreign Application Priority Data

Nov. 2, 2007 (TW) ..... 96141606 A

(51) Int. Cl.
*G09G 5/10* (2006.01)

(52) U.S. Cl.
USPC ..... 345/690

(58) Field of Classification Search
USPC ..... 345/87–100, 204, 690, 691
See application file for complete search history.

(56) References Cited

U.S. PATENT DOCUMENTS 7,375,707 B1 * 5/2008 Lee ..... 345/89
2003/0132903 A1 * 7/2003 Ueda ..... 345/87
2007/0063947 A1 * 3/2007 Kang ..... 345/89
2007/0120791 A1 * 5/2007 Takahashi ..... 345/89
2007/0290964 A1 * 12/2007 Yang ..... 345/87
2008/0012811 A1 * 1/2008 Sung et al. ..... 345/89

OTHER PUBLICATIONS

Hsuan-Lin Pan; Po-Sheng Shih Taiwan Patent Application No. 96115705 (not published yet) Filed May 3, 2007 "Liquid Crystal Display Panel and Diriving Method Thereof".

* cited by examiner

*Primary Examiner* — Rodney Amadiz
(74) *Attorney, Agent, or Firm* — Volpe and Koenig, P.C.

(57) ABSTRACT

A pixel driving method for a display device is provided. The display device includes at least a first and a second pixels coupled to a signal terminal. The first pixel is located farther from the signal terminal than the second pixel, and each pixel is driven during a time period, which includes a first operation period and a second operation period. The pixel driving method includes steps of generating a compensation voltage and an ideal voltage according to a gray scale value of the each pixel, charging/discharging the each pixel by the compensation voltage corresponding to the each pixel during the respective first operation period, and charging/discharging the each pixel by the ideal voltage corresponding to the each pixel during the respective second operation period. The first operation period for charging/discharging the first pixel is longer than that for charging/discharging the second pixel.

8 Claims, 7 Drawing Sheets

PIXEL DRIVING METHOD FOR DISPLAY DEVICE

FIELD OF THE INVENTION

The present invention relates to a pixel driving method for a display, and more particularly to a pixel driving method for a liquid crystal display.

BACKGROUND OF THE INVENTION

Recently the technologies of the liquid crystal displays have been advanced and improved quickly. Moreover, the production cost of the liquid crystal displays is continuously reduced. Therefore, the traditional cathode ray tubes (CRT) are almost completely replaced by the liquid crystal displays (LCD) in the market of the monitors. As the technologies of LCD are being improved greatly, the market of LCD TV is growing fast, and the requirements and expectations for the performance of the LCD TV become higher and higher, for example, high-resolution (e.g. 1920×1080 pixels), fast response time, no sluggish motion picture, etc.

In order to solve the problem of sluggish motion pictures in LCD TV, it is frequently necessary to double the scanning frequency from traditional 60 hertz (60 pictures per second) to 120 hertz (120 pictures per second) by inserting the pictures of the gray scale values. Although the doubled frequency can improve the fluency of the motion pictures, however the doubled frequency also reduces the driving time for each pixel, and the pixels are insufficiently changed/discharged.

For solving the above-mentioned problem, the inventor of the present invention has proposed a solution by charging/discharging with a higher voltage in the first charging/discharging period and charging/discharging with a normal ideal voltage in the second charging/discharging period in the Taiwan Patent Application No. 96115705. In this way, the pixels can still be charged/discharged to the ideal voltage, even when the charging/discharging period is reduced to one half due to the doubled frequency. The concept of this method is great. Nevertheless, as the resolution of the LCD panel becomes higher and higher up to 1920×1080 pixels (full high definition), the phenomenon of RC delay becomes even serious. There is much difference in the reachable operation voltages between the pixels near and those far from the signal terminals of the data driving chips or gate driving chips. It is explained in the following with reference to the drawings.

FIGS. 1(*a*)~1(*b*), FIGS. 2(*a*)~2(*b*) and FIGS. 3(*a*)~3(*b*) are schematic diagrams showing the pixel voltages during the charging processes by using the traditional techniques. Please refer to FIG. 1(*a*), which is a schematic diagram showing the charging condition of the nearest pixel to the signal terminal, where the pixel voltage ($V_{pixel}$) is higher than the ideal voltage after charging, i.e. overcharging. Please refer to FIG. 1(*b*), which is a schematic diagram showing the charging condition of the farthest pixel from the signal terminal, where the pixel voltage ($V_{pixel}$) is the same as the ideal voltage after charging. Please refer to FIG. 2(*a*), which is a schematic diagram showing the charging condition of the nearest pixel to the signal terminal, where the pixel voltage ($V_{pixel}$) is the same as the ideal voltage after charging. Please refer to FIG. 2(*b*), which is a schematic diagram showing the charging condition of the farthest pixel from the signal terminal, where the pixel voltage ($V_{pixel}$) is lower than the ideal voltage after charging, i.e. insufficient charging. Please refer to FIG. 3(*a*), which is a schematic diagram showing the charging condition of the nearest pixel to the signal terminal, where the pixel voltage ($V_{pixel}$) is higher than the ideal voltage after charging, i.e. overcharging. Please refer to FIG. 3(*b*), which is a schematic diagram showing the charging condition of the farthest pixel from the signal terminal, where the pixel voltage ($V_{pixel}$) is lower than the ideal voltage after charging, i.e. insufficient charging.

According to FIGS. 1(*a*)~1(*b*), FIGS. 2(*a*)~2(*b*) and FIGS. 3(*a*)~3(*b*), it can be known that the RC delay condition becomes serious particularly for those pixels far from the signal terminals, since the driving signals generated by the data driving chips or the gate driving chips need to pass much more other pixels in the high-resolution LCD panel. Therefore, it is hard to control the charging conditions, and the following conditions frequently occur. The pixels near the signal terminals are overcharged, as shown in FIG. 1(*a*), the pixels far from the signal terminals are insufficiently charged, as shown in FIG. 2(*b*), or even both overcharging and insufficient charging occur at the same time, as shown in FIGS. 3(*a*)~3(*b*).

In order to solve the above-mentioned problems, the new concept and the solution method are proposed in the present invention to allow every pixel in the high-resolution LCD panel to be charged/discharged to the ideal voltage even under the operation of the doubled frequency. The present invention is described below.

SUMMARY OF THE INVENTION

The present invention provides a pixel driving method for LCD devices to solve the problem of non-uniform charging for the pixels in the LCD panel.

In accordance with one aspect of the present invention, a pixel driving method for a display device is provided. The display device includes at least a first and a second pixels coupled to a signal terminal. The first pixel is located farther from the signal terminal than the second pixel, and each pixel is driven during a time period, which includes a first operation period and a second operation period. The pixel driving method includes steps of generating a compensation voltage and an ideal voltage according to a gray scale value of the each pixel, charging/discharging the each pixel by the compensation voltage corresponding to the each pixel during the respective first operation period, and charging/discharging the each pixel by the ideal voltage corresponding to the each pixel during the respective second operation period. The first operation period for charging/discharging the first pixel is longer than that for charging/discharging the second pixel.

Preferably, the compensation voltage of the first pixel is higher than that of the second pixel.

Preferably, the compensation voltage of the first pixel is equal to that of the second pixel.

Preferably, the compensation voltage of the first pixel is lower than that of the second pixel.

In accordance with another aspect of the present invention, a pixel driving method for a display device is provided. The display device includes at least a first and a second pixels coupled to a signal terminal. The first pixel is located farther from the signal terminal than the second pixel, and each pixel is driven during a time period, which includes a first operation period and a second operation period. The pixel driving method includes steps of generating a first compensation voltage and a second compensation voltage corresponding to the first pixel and the second pixel respectively based on a same gray scale value, generating an ideal voltage corresponding to the first pixel and the second pixel based on the same gray scale value, charging/discharging the first pixel by the first compensation voltage during the first operation period of the time period for driving the first pixel, charging/discharging the second pixel by the second compensation voltage during the first operation period of the time period for driving the second pixel, charging/discharging the first pixel by the ideal voltage during the second operation period of the time period for driving the first pixel, and charging/discharging the second pixel by the ideal voltage during the second operation period of the time period for driving the second pixel. A first voltage difference between the first compensation voltage and the ideal voltage is larger than a second voltage difference between the second compensation voltage and the ideal voltage.

Preferably, the first operation period of the time period for driving the first pixel is longer than that for driving the second pixel.

Preferably, the first operation period of the time period for driving the first pixel is equal to that for driving the second pixel.

Preferably, the first operation period of the time period for driving the first pixel is shorter than that for driving the second pixel.

In accordance with a further aspect of the present invention, a pixel driving method for a display device is provided. The display device includes at least a first and a second pixels coupled to a signal terminal. The first pixel is located farther from the signal terminal than the second pixel. The first pixel is driven during a first time period, which includes a first operation period and a second operation period. The second pixel is driven during a second time period, which includes a third operation period and a fourth operation period. The pixel driving method includes steps of generating a first compensation voltage and a second compensation voltage corresponding to the first pixel and the second pixel respectively based on a same gray scale value, generating an ideal voltage corresponding to the first pixel and the second pixel based on the same gray scale value, charging/discharging the first pixel by the first compensation voltage during the first operation period, charging/discharging the second pixel by the second compensation voltage during the third operation period, charging/discharging the first pixel by the ideal voltage during the second operation period, and charging/discharging the second pixel by the ideal voltage during the fourth operation period. The first operation period is longer than the third operation period, and a first voltage difference between the first compensation voltage and the ideal voltage is larger than a second voltage difference between the second compensation voltage and the ideal voltage.

Preferably, the first and second compensation voltages are generated based on a compensation gamma curve.

Preferably, the ideal voltage is generated based on an ideal gamma curve.

Preferably, the display device is a liquid crystal display device.

Preferably, the signal terminal comprises one of a data driving chip and a gate driving chip.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

First Embodiment

Figure 1B:
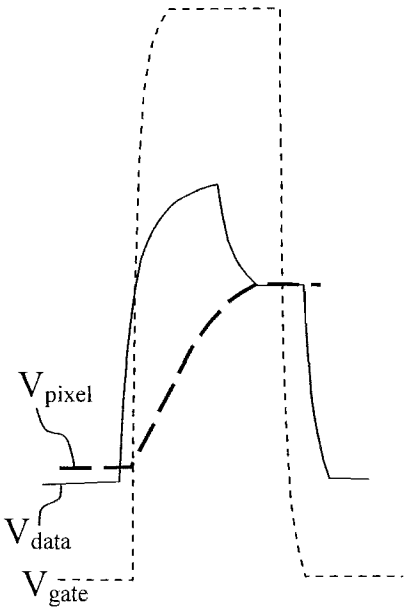
Fig. 1(b)(prior art)
FIGS. 1(*a*)~1(*b*), FIGS. 2(*a*)~2(*b*) and FIGS. 3(*a*)~3(*b*) are schematic diagrams showing the pixel voltages during the charging processes by using the traditional techniques.
Figure 1A:
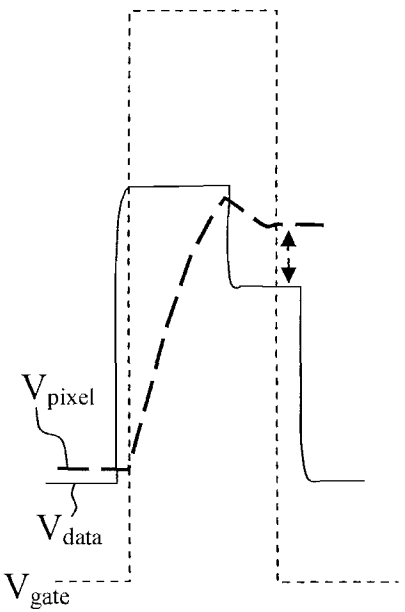
Fig. 1(a)(prior art)
Figure 2B:
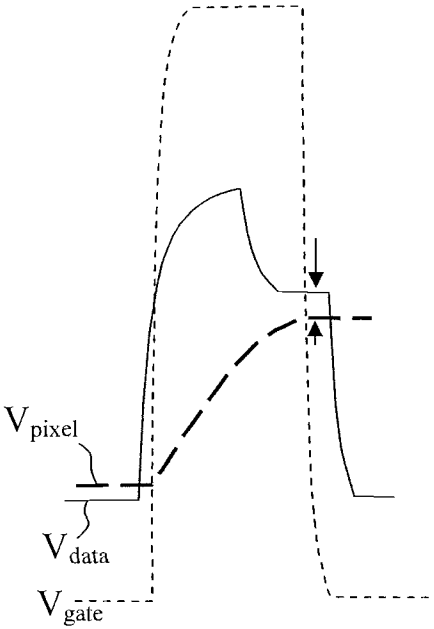
Fig. 2(b)(prior art)
Figure 2A:
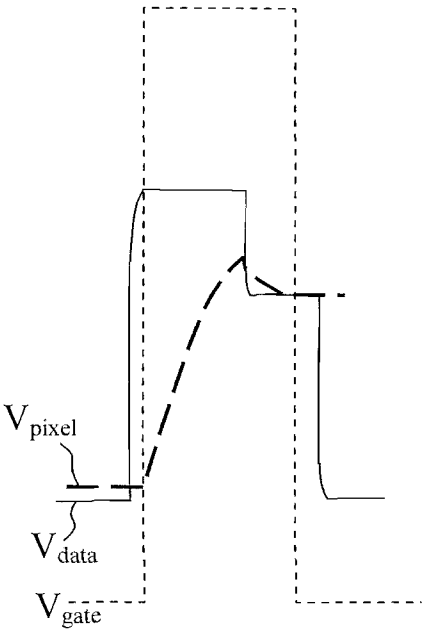
Fig. 2(a)(prior art)
Figure 3B:
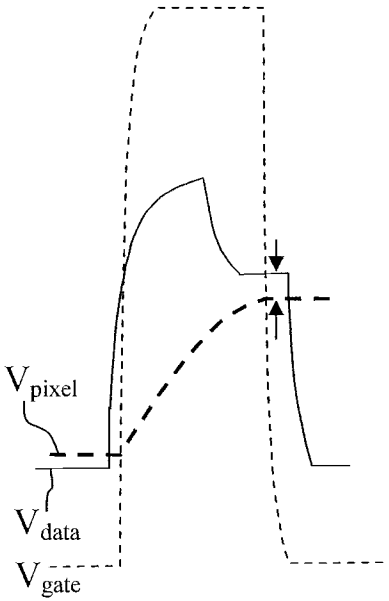
Fig. 3(b)(prior art)
Figure 3A:
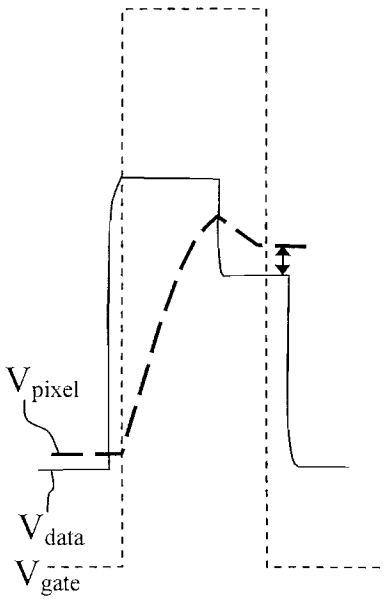
Fig. 3(a)(prior art)
Figure 4B:
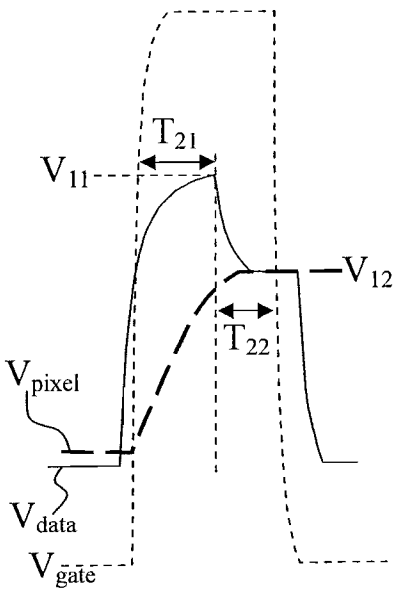
FIGS. 4(*a*)~4(*b*) are schematic diagrams showing the pixel voltages during the charging processes according to the first embodiment of the present invention.
Figure 4A:
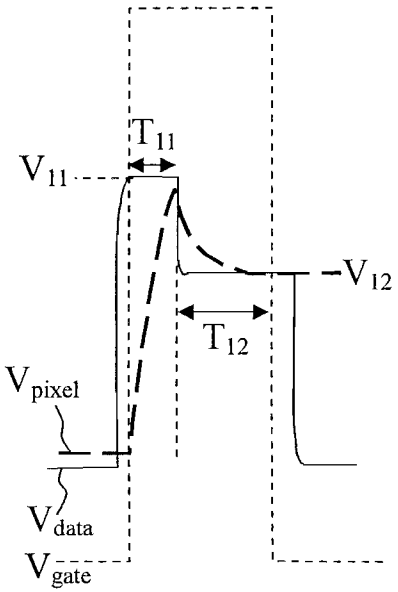

Please refer to FIGS. 4(*a*)~4(*b*), which are schematic diagrams showing the pixel voltages during the charging processes according to the first embodiment of the present invention, i.e. the schematic diagrams of the pixel voltages under the positive frame charging. The gate voltage ($V_{gate}$) is used to initiate the pixel in order to charge the pixel with data voltage ($V_{data}$), and the actual voltage of the pixel is denoted as $V_{pixel}$. FIG. 4(*a*) shows the charging condition of the nearest pixel to the signal terminal; while FIG. 4(*b*) shows the charging condition of the farthest pixel from the signal terminal. In this embodiment, the gamma curve can be used to generate the compensation voltage $V_{11}$ and ideal voltage $V_{12}$, by considering the parameters of the liquid crystal design, the pixel design, the panel circuit design and so on of the LCD panel. For example, the compensated and ideal gamma curves can be used to generate the compensation voltage $V_{11}$ and ideal voltage $V_{12}$, respectively. Regarding the operation method of the compensated and ideal gamma curves, please refer to the disclosure of the Taiwan Patent Application No. 96115705 with the same inventors of the present invention. After then, the data voltage $V_{data}$ is set to compensation voltage $V_{11}$, which is applied to charge the pixels during the first operation period $T_{11}$ (or $T_{21}$). Then the data voltage $V_{data}$ is set to the ideal voltage $V_{12}$, which is applied to charge the pixels during the second operation period $T_{12}$ (or $T_{22}$), so that the pixel voltages $V_{pixel}$ can reach the ideal voltages $V_{12}$ before the charge is finished. It generally takes longer for the actual pixel voltage $V_{pixel}$ to reach the input data voltage $V_{data}$ due to the influence of the RC delay. FIG. 4(*a*) shows the charging condition of the nearest pixel to the signal terminal. Since the RC delay is small for this pixel, therefore the first operation period $T_{11}$ for charging by the compensation voltage $V_{11}$ can be appropriately shortened for fear that the pixel voltage $V_{pixel}$ is higher than the ideal voltage $V_{12}$ after all charging. FIG. 4(*b*) shows the charging condition of the farthest pixel from the signal terminal. Since the RC delay is large for this pixel, therefore the first operation period $T_{21}$, for charging by compensation voltage $V_{11}$ can be appropriately elongated for fear that the pixel voltage $V_{pixel}$ is lower than the ideal voltage $V_{12}$ after all charging. FIGS. 4(*a*)~4(*b*) show the same voltage level of compensation voltage $V_{11}$ in the nearest and in the farthest pixels to the signal terminal in this embodiment, but the compensation voltage in the farthest pixel to the signal terminal can be also appropriately higher than the compensation voltage in the nearest pixel to the signal terminal for adjusting the voltage level of the pixel voltage $V_{pixel}$ to reach the ideal voltage $V_{12}$. Similarly, in some special conditions, the compensation voltage in farthest pixel to the signal terminal can be also appropriately lower than the compensation voltage in the nearest pixel to the signal terminal for compensating the voltage level of the pixel voltage $V_{pixel}$ to reach the ideal voltage $V_{12}$.

In this embodiment, all the pixels can be charged to the respective ideal voltages $V_{12}$ after charging, no matter where these pixels are located, and no matter what gray scale values are these pixels, by adjusting the first operation period $T_{11}$ (or $T_{21}$) and the second operation period $T_{12}$ (or $T_{22}$), i.e. by adjusting the relative charging durations of the compensation voltage $V_{11}$ and the ideal voltage $V_{12}$. The method of adjusting the first operation period $T_{11}$ (or $T_{21}$) and the second operation period $T_{12}$ (or $T_{22}$) is based on the distances between the pixels and the signal terminals. When the distance between the pixel and the signal terminal is longer, the first operation period $T_{11}$ (or $T_{21}$) for that pixel is longer in order to compensate the larger RC delay. By this method, all the pixels in the LCD panel can be charged to the respective ideal voltages $V_{12}$ after the charging without any discrepancy, even though the RC delay conditions for each pixel are different. In the prior arts, the discrepancy in the actual voltages for each pixel after charging is seriously large, especially for the high-resolution or large-size LCD panels. This problem can be effectively solved by the method of this embodiment.

Second Embodiment

Figure 5B:
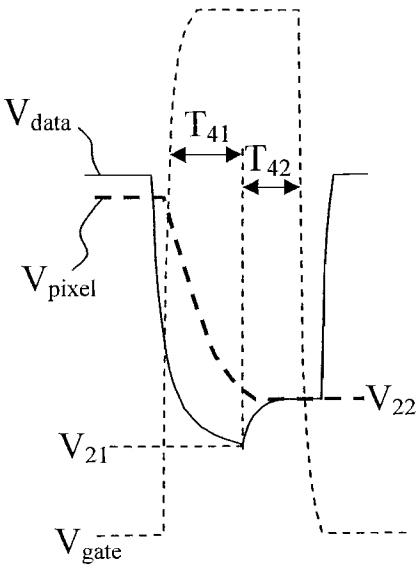
FIGS. 5(*a*)~5(*b*) are schematic diagrams showing the pixel voltages during the charging processes according to the second embodiment of the present invention.
Figure 5A:
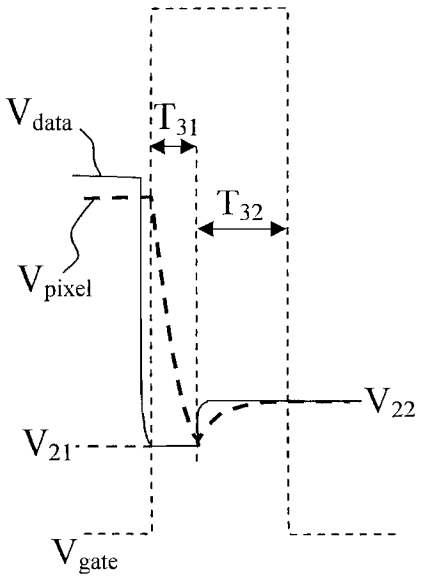

Actually the charging or discharging process for each pixel in the LCD panel is continuously proceeding according to the practical requirements of the darkness or brightness for each pixel in every specific time. The concepts of the present invention can also be applied to the discharging processes, i.e. the negative frame processes, certainly. FIGS. 5(*a*)~5(*b*) are schematic diagrams showing the pixel voltages during the discharging processes, i.e. the negative frame processes, according to the second embodiment of the present invention. Please refer to FIGS. 5(*a*)~5(*b*). Similarly, FIG. 5(*a*) shows the discharging condition of the nearest pixel to the signal terminal; while FIG. 5(*b*) shows the discharging condition of the farthest pixel from the signal terminal. In this embodiment, all the pixels in the LCD panel can be discharged to the ideal voltage by the method of adjusting the relative durations of the first operation period and the second operation period, i.e. by the same adjusting method as that in the first embodiment. The difference between this embodiment and the first embodiment is described below. It is a discharging process in this embodiment; while it is a charging process in the first embodiment. In the charging process, the pixel voltage $V_{pixel}$ is increased. On the contrary, in the discharging process, the pixel voltage $V_{pixel}$ is decreased.

FIG. 5(*a*) shows the discharging condition of the nearest pixel to the signal terminal. The first operation period $T_{31}$ for discharging by the compensation voltage $V_{21}$ can be appropriately shortened, since the RC delay is small in this pixel for fear that the pixel voltage $V_{pixel}$ may be over-discharged below the ideal voltage $V_{22}$. FIG. 5(*b*) shows the discharging condition of the farthest pixel from the signal terminal. The first operation period $T_{41}$ for discharging by the compensation voltage $V_{21}$, can be appropriately elongated, since the RC delay is large in this pixel so that the pixel voltage $V_{pixel}$ can reach the ideal voltage $V_{22}$ after discharging. FIGS. 5(*a*)~5(*b*) show the same voltage level of compensation voltage $V_{21}$ in the nearest and in the farthest pixels to the signal terminal in this embodiment, but the compensation voltage in the farthest pixel to the signal terminal can be also appropriately lower than the compensation voltage in the nearest pixel to the signal terminal for adjusting the voltage level of the pixel voltage $V_{pixel}$ to reach the ideal voltage $V_{12}$. Similarly, in some special conditions, the compensation voltage in the farthest pixel to the signal terminal can be also appropriately higher than the compensation voltage in the nearest pixel to the signal terminal for compensating the voltage level of the pixel voltage $V_{pixel}$ to reach the ideal voltage $V_{12}$.

Similarly, all the pixels can be discharged to the respective ideal voltages $V_{22}$ after discharging, no matter where these pixels are located, and no matter what gray scale values are these pixels, by adjusting the first operation period $T_{31}$ (or $T_{41}$) and the second operation period $T_{32}$ (or $T_{42}$), i.e. by adjusting relative discharging durations for the compensation voltage $V_{21}$ and the ideal voltage $V_{22}$. The method of adjusting the first operation period $T_{31}$ (or $T_{41}$) and the second operation period $T_{32}$ (or $T_{42}$) is based on the distances between the pixels and the signal terminals. When the distance between the pixel and the signal terminal is longer, the first operation period $T_{31}$ (or $T_{41}$) for that pixel is longer in order to compensate the larger RC delay. By this method, all the pixels in the LCD panel can be discharged to the respective ideal voltages $V_{22}$ after the discharging.

Third Embodiment

Figure 6B:
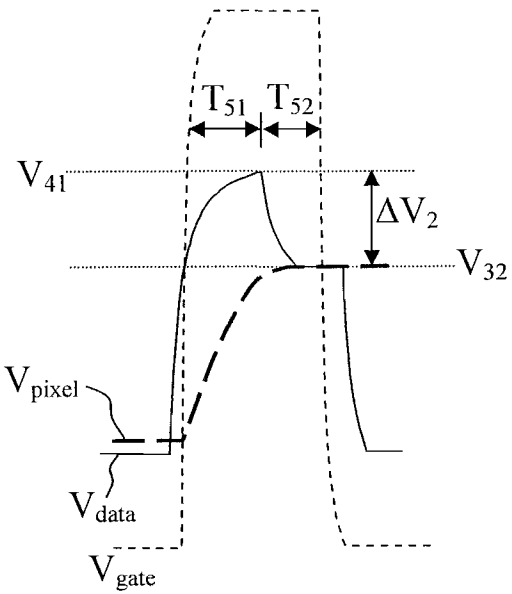
FIGS. 6(*a*)~6(*b*) are schematic diagrams showing the pixel voltages during the charging processes according to the third embodiment of the present invention.
Figure 6A:
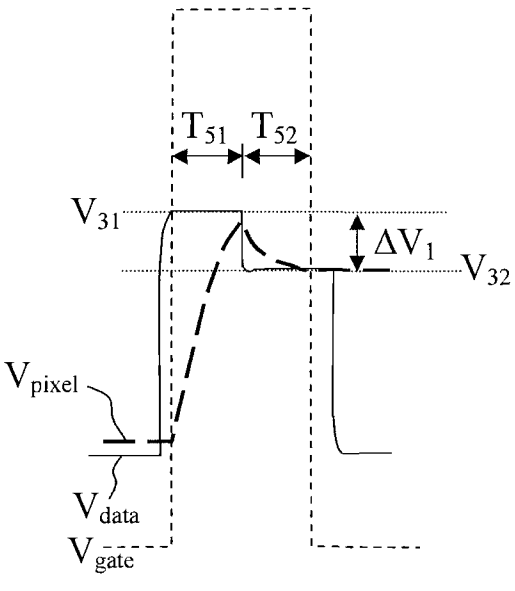

FIGS. 6(*a*)~6(*b*) are schematic diagrams showing the pixel voltages during the charging processes, i.e. the positive frame processes, according to the third embodiment of the present invention. Please refer to FIGS. 6(*a*)~6(*b*). FIG. 6(*a*) shows the charging condition of the nearest pixel to the signal terminal; while FIG. 6(*b*) shows the charging condition of the farthest pixel from the signal terminal. The difference between this embodiment and the first embodiment is described as follows. The first embodiment is using the method of adjusting the relative durations of the first operation period and the second operation period for various pixels in order that each pixel in the LCD panel can be charged to the respective ideal voltage after charging; while this embodiment is using the method of adjusting the magnitudes of the compensation voltages so that each pixel in the LCD panel can be charged to the respective ideal voltage after charging. The above-mentioned compensation and ideal voltages can be generated by applying the compensation and ideal gamma curves, respectively.

FIG. 6(*a*) shows the charging condition of the nearest pixel to the signal terminal. The data voltage $V_{data}$ is set to the compensation voltage $V_{31}$, which is applied to charge the pixel during the first operation period $T_{51}$. After then the data voltage $V_{data}$ is set to the ideal voltage $V_{32}$, which is applied to charge the pixel during the second operation period $T_{52}$ in order that the pixel voltage $V_{pixel}$ can reach the ideal voltage $V_{32}$ after charging. Since the RC delay is small in this pixel, thus the compensation voltage $V_{31}$ is a little higher than the ideal voltage $V_{32}$.

FIG. 6(*b*) shows the charging condition of the farthest pixel from the signal terminal. The data voltage $V_{data}$ is set to the compensation voltage $V_{41}$, which is applied to charge the pixel during the first operation period $T_{51}$. After then the data voltage $V_{data}$ is set to the ideal voltage $V_{32}$, which is applied to charge the pixel during the second operation period $T_{52}$ in order that the pixel voltage $V_{pixel}$ can reach the ideal voltage $V_{32}$ after charging. In this embodiment, the ideal voltages are assumed to be the same value $V_{32}$, i.e. the same gray scale value for the explanation, in both FIGS. 6(*a*) and 6(*b*). Since the pixel in FIG. 6(*b*) is located farther from the signal terminal than that in FIG. 6(*a*), the RC delay is larger for the pixel in FIG. 6(*b*) than that in FIG. 6(*a*). Therefore the compensation voltage $V_{41}$ is designed to be much higher than the ideal voltage $V_{32}$ in order to compensate the larger RC delay for the pixel in FIG. 6(*b*). FIGS. 6(*a*)~6(*b*) show the same time period of the first operation period $T_{51}$ in the nearest and the farthest pixels to the signal terminal in this embodiment, but the first operation period of the farthest pixel to the signal terminal can be also appropriately elongated for adjusting the voltage level of the pixel voltage $V_{pixel}$ to reach the ideal voltage $V_{12}$. Similarly, in some special conditions, the first operation period in the farthest pixel to the signal terminal can be also appropriately shortened for compensating the voltage level of the pixel voltage $V_{pixel}$ to reach the ideal voltage $V_{12}$.

The voltage difference $\Delta V_1$, is the absolute value of the voltage difference between the compensation voltage $V_{31}$ and the ideal voltage $V_{32}$, and the voltage difference $\Delta V_2$, is the absolute value of the voltage difference between the compensation voltage $V_{41}$, and the ideal voltage $V_{32}$. The $\Delta V_1$ in FIG. 6(*a*) is smaller than the $\Delta V_2$ in FIG. 6(*b*), after comparing FIGS. 6(*a*) and 6(*b*).

In this embodiment, the compensation voltage for each pixel is adjusted according to the distance between each pixel and the signal terminal. When the pixel is located farther from the signal terminal, the compensation voltage for this pixel is higher in order that each pixel in the LCD panel can be charged to the corresponding ideal voltage.

Fourth Embodiment

Figure 7B:
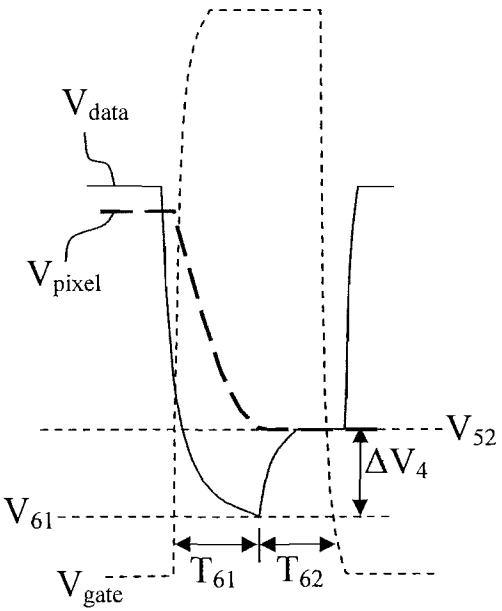
FIGS. 7(*a*)~7(*b*) are schematic diagrams showing the pixel voltages during the charging processes according to the fourth embodiment of the present invention.
Figure 7A:
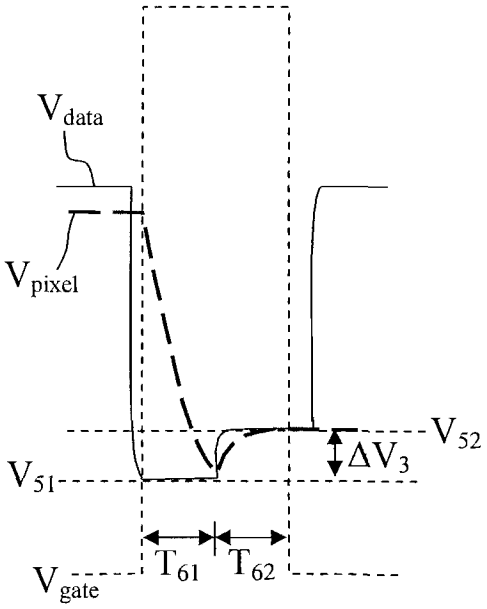

FIGS. 7(*a*)~7(*b*) are schematic diagrams showing the pixel voltages during the discharging processes, i.e. the negative frame processes, according to the fourth embodiment of the present invention. Please refer to FIGS. 7(*a*)~7(*b*). FIG. 7(*a*) shows the discharging condition of the nearest pixel to the signal terminal; while FIG. 7(*b*) shows the discharging condition of the farthest pixel from the signal terminal. The same method of adjusting the respective magnitude of the compensation voltage for each pixel as that in the third embodiment is used in this embodiment in order that each pixel in the LCD panel can be charged/discharged to the corresponding ideal voltage. The difference between this embodiment and the third embodiment is described below. It is a discharging process in this embodiment; while it is a charging process in the third embodiment. In the charging process, the pixel voltage $V_{pixel}$ is increased. On the contrary, in the discharging process, the pixel voltage $V_{pixel}$ is decreased.

Please refer to FIG. 7(*a*), which shows the discharging condition of the nearest pixel to the signal terminal. The data voltage $V_{data}$ is set to the compensation voltage $V_{51}$, which is applied to discharge the pixel during the first operation period $T_{61}$. After then the data voltage $V_{data}$ is set to the ideal voltage $V_{52}$, which is applied to discharge the pixel during the second operation period $T_{62}$ in order that the pixel voltage $V_{pixel}$ can reach the ideal voltage $V_{52}$ after discharging. Since the RC delay is small in this pixel, thus the compensation voltage $V_{51}$ is a little lower than that of the ideal voltage $V_{52}$.

Please refer to FIG. 7(*b*), which shows the discharging condition of the farthest pixel from the signal terminal. The data voltage $V_{data}$ is set to the compensation voltage $V_{61}$, which is applied to discharge the pixel during the first operation period $T_{61}$. After then the data voltage $V_{data}$ is set to the ideal voltage $V_{52}$, which is applied to discharge the pixel during the second operation period $T_{62}$ in order that the pixel voltage $V_{pixel}$ can reach the ideal voltage $V_{52}$ after discharging. Since the RC delay is large in this pixel, thus the compensation voltage $V_{61}$ is much lower than that of the ideal voltage $V_{52}$ so as to compensate the larger RC delay. It is also to be noted that, in this embodiment, the ideal voltages are assumed to be the same value $V_{52}$, i.e. the same gray level value for the explanation, in both FIGS. 7(*a*) and 7(*b*). FIGS. 7(*a*)~7(*b*) show the same time period of the first operation period $T_{61}$ in the nearest and the farthest pixels to the signal terminal in this embodiment, but the first operation period of the farthest pixel to the signal terminal can be also appropriately elongated for adjusting the voltage level of the pixel voltage $V_{pixel}$ after all charging. Similarly, in some special conditions, the first operation period in the farthest pixel to the signal terminal can be also appropriately shortened for compensating the voltage level of the pixel voltage $V_{pixel}$ after all charging.

The voltage difference $\Delta V_3$, is the absolute value of the voltage difference between the compensation voltage $V_{51}$ and the ideal voltage $V_{52}$, and the voltage difference $\Delta V_4$, is the absolute value of the voltage difference between the compensation voltage $V_{61}$ and the ideal voltage $V_{52}$. The $\Delta V_3$ in FIG. 7(*a*) is smaller than the $\Delta V_4$ in FIG. 7(*b*), after comparing FIGS. 7(*a*) and 7(*b*).

In this embodiment, the compensation voltage for each pixel is adjusted according to the distance between each pixel and the signal terminal. When the pixel is located farther from the signal terminal, the compensation voltage for this pixel is lower in order that each pixel in the LCD panel can be discharged to the corresponding ideal voltage.

According to the spirit of the present invention, it is certainly feasible to combine the method of the first embodiment (or second embodiment) with that of the third embodiment (or fourth embodiment) so that each pixel in the LCD panel can be charged (or discharged) to the corresponding ideal voltage, no matter how far the pixel is from the signal terminal and where the pixel is located, and no matter what the gray scale value is the pixel, by adjusting the first and second compensation periods and the compensation voltage together. When the pixel is located farther from the signal terminal, the first operation period for this pixel is appropriately elongated, and the compensation voltage for this pixel is raised. On the contrary, when the pixel is located nearer to the signal terminal, the first operation period for this pixel is appropriately shortened, and the compensation voltage for this pixel is decreased.

From the above description, the present invention provides pixel driving methods applied to the LCD or other display devices by adjusting the compensation voltage and the duration for applying the compensation voltage so that each pixel in the LCD panel can be charged/discharged to the corresponding ideal voltage. These methods can effectively solve the problem of insufficient charging/discharging in high-frequency operation, e.g. 120 hertz, and also the problem of the inability to reach the corresponding ideal voltage for each pixel due to significant RC delay conditions for high-resolution or large-size LCD panels. Therefore the motion pictures can be fluently displayed in high-resolution LCD panels, and the performance of the LCD TV can be remarkably improved by the methods of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A pixel driving method for a display device comprising at least a first and a second pixel coupled to a signal terminal and connected with a data line, wherein the first pixel is located farther from the signal terminal than the second pixel, and each pixel is driven during a time period comprising a first operation period and a second operation period, comprising steps of:

generating a compensation voltage and an ideal voltage according to a gray scale value of each pixel;

charging or discharging each pixel by the compensation voltage corresponding to each pixel through the data line during the respective first operation period; and charging or discharging each pixel by the ideal voltage corresponding to each pixel through the data line during the respective second operation period;

wherein the first operation period for charging or discharging the first pixel is longer than that for charging or discharging the second pixel, and the compensation voltage has an absolute value larger than that of the ideal voltage.

2. A pixel driving method as claimed in claim 1, wherein the compensation voltage is generated based on a compensation gamma curve.

3. A pixel driving method as claimed in claim 1, wherein the ideal voltage is generated based on an ideal gamma curve.

4. A pixel driving method as claimed in claim 1, wherein the display device is a liquid crystal display device.

5. A pixel driving method as claimed in claim 1, wherein the signal terminal comprises one of a data driving chip and a gate driving chip.

6. A pixel driving method as claimed in claim 1, wherein the compensation voltage of the first pixel is higher than that of the second pixel.

7. A pixel driving method as claimed in claim 1, wherein the compensation voltage of the first pixel is equal to that of the second pixel.

8. A pixel driving method as claimed in claim 1, wherein the compensation voltage of the first pixel is lower than that of the second pixel.

* * * * *